United States Patent [19]

Niwa

[11] 4,344,061

[45] Aug. 10, 1982

[54] TEMPERATURE-SENSITIVE FUSE

[75] Inventor: Yoshio Niwa, Kawasaki, Japan

[73] Assignee: Showa Electric Wire & Cable Co., Ltd., Kanagawa, Japan

[21] Appl. No.: 184,357

[22] Filed: Sep. 5, 1980

[30] Foreign Application Priority Data

Sep. 11, 1979 [JP] Japan ..... 54-116594

[51] Int. Cl.[3] ..... H01H 37/76

[52] U.S. Cl. ..... 337/407; 337/409

[58] Field of Search ..... 337/407, 408, 409

[56] References Cited

U.S. PATENT DOCUMENTS

| | | | |
|---|---|---|---|
| 4,189,697 | 2/1980 | Hara | 337/407 |
| 4,210,893 | 7/1980 | Hara | 337/407 |
| 4,246,561 | 1/1981 | McVey | 337/409 X |

*Primary Examiner*—George Harris

*Attorney, Agent, or Firm*—Kenway & Jenney

[57] ABSTRACT

A temperature-sensitive fuse comprises a first electric conductor electrically connected to one end of an electrically conductive casing; a second electric conductor which is connected to the other end of the casing in such a manner so as to be electrically insulated therefrom; a temperature-sensitive, fusible pellet disposed in the end portion of the casing containing the first conductor; a movable disc member which is disposed between the fusible pellet and the top portion of the second conductor, normally in contact with the top portion of the second conductor and the inner wall of the casing, and held by a spring in such a manner that when the fusible pellet melts and collapses at a predetermined ambient temperature, the movable disc is moved away from the top portion of the second conductor. Further, the top portion of the second conductor is rounded or formed in the shape of a circular cone and is substantially fitted into a tapered opening formed in the central portion of the disc, in the axial direction of the tubular casing. In one portion of the disc, there is formed a slit which is open from the tapered opening to an outer peripheral portion of the disc.

4 Claims, 6 Drawing Figures

TEMPERATURE-SENSITIVE FUSE

BACKGROUND OF THE INVENTION

The present invention relates to a temperature-sensitive fuse and more particularly to a temperature-sensitive fuse capable of interrupting or breaking an electric circuit when a predetermined ambient temperature is reached.

Conventionally, a temperature-sensitive fuse is known, which comprises a cylindrical, tubular, electrically-conductive casing with a first conductor electrically connected to one end of the casing, and a second conductor projecting into the other end of the casing in such a manner as to be electrically insulated therefrom; a temperature-sensitive, fusible pellet disposed in the end portion of the casing containing the first conductor; and an electrically conductive, movable member held between the fusible pellet and the inner top portion of the second conductor, which is normally in contact with the fusible pellet and the inner wall of the casing, thereby completing the electrical connection between the first conductor and the second conductor, and when a predetermined ambient temperature is reached and the pellet therefore melts and collapses, the movable member being moved away from the second conductor, thereby breaking the electrical connection between the first conductor and the second conductor, and interrupting the circuit.

In U.S. Pat. No. 3,781,737 and U.S. Pat. No. 3,924,218, there is disclosed a temperature-sensitive fuse of the above-mentioned type employing three metallic balls which serve as the above-mentioned movable member and which are disposed in contact with the top portion of the second conductor and the inner wall of the casing.

However, in a temperature-sensitive fuse employing the three metallic balls, unless all three metallic balls are disposed in uniform contact with the top portion of the second conductor and the inner wall of the casing, there is a risk that those balls may not work smoothly as the movable member when the fusible pellet melts and collapses. Therefore, in producing such temperature-sensitive fuses, it is required that those metallic balls be positioned accurately in uniform contact with the top portion of the second conductor and the inner wall of the casing. However, in practice, it is extremely difficult to produce these temperature-sensitive fuses, satisfying that requirement.

Further, when the fusible pellet is in the normal state of being solid and uncollapsed, the three metallic balls are in pressure contact with the top portion of the second conductor by the compression spring. If the force exerted on the balls by the compression spring is great, the balls may be moved outwards towards the surface of the tubular casing and positioned so as to cut into the surface of the inner wall of the casing. When the balls are in such a forced positioned, they do not move when the pellet melts and collapses.

Since the temperature-sensitive fuse is employed as an emergency switch, it is an indispensable requirement that it work without fail to interrupt an electric circuit under a predetermined condition and, therefore, any tendency of the above-mentioned movable members not to operate has to be avoided by all means.

Further, in U.S. Pat. No. 3,519,972, U.S. Pat. No. 3,778,742 and U.S. Pat. No. 4,001,754, there are disclosed temperature-sensitive fuses employing a flat disc as the movable member. In these temperature-sensitive fuses, a central portion of the disc is in contact with the top portion of the second conductor, while the other peripheral portion of the disc is in contact with the inner wall of the casing. In these temperature-sensitive fuses, an extremely thin, flat disc is employed, possibly for the following reason: Normally, the disc has to be in as close as possible contact with the inner wall of the casing for assuring electric current flow from the casing to the disc. Further, upon melting and collapsing of the fusible pellet, the disc is required to slide quickly along the inner wall of the casing, away from the second conductor.

These functions of the disc can be attained, for example, by designing the disc so as to be as thin as approximately 0.1 mm, increasing the resilience of the disc. However, such a thin disc will give rise to various problems in the temperature-sensitive fuse. For example, the thin disc has to be reinforced by attaching an additional disc thereto. In manufacturing the temperature-sensitive fuses whose monthly production rate is in the range of several hundred thousand to several million units, an additional part (the reinforcing disc), even if it is but a single additional part for each temperature-sensitive fuse, will have a significant effect on the production-line operation and cost.

Furthermore, great manufacturing care is required to dispose such a thin disc accurately in the right position in the casing. Specifically, the thin disc has to be positioned accurately normal to the second conductor. If the disc is inclined, sticking may occur and the secure and quick operation of the temperature-sensitive fuse cannot be guaranteed in an emergency.

Further, when the fusible pellet melts and collapses and the disc is moved away from the second conductor, since the peripheral portion of the disc is in pressure contact with the inner wall of the casing, and thus there is sliding friction between them, it could happen that the force exerted to move the disc against the molten pellet would be insufficient. When that happens, a sufficient space is not obtained between the disc and the second conductor, so that the breakdown voltage is reduced. Further, a comparatively long time is required before the disc is separated from the conductor due to the friction between the disc and the inner wall of the casing, resulting in the production of electric sparks between them and the disc being joined to the inner wall of the casing by the heat of the electric sparks, so that the interruption of the electric circuit is hindered.

SUMMARY OF THE INVENTION

It is therefore a primary object of the present invention to provide a temperature-sensitive fuse which is electrically stable in allowing electric current to pass through in its normal condition and capable of interrupting or breaking an electric circuit reliably at the desired timing in an emergency, from which the above-described drawbacks in the prior-art fuse means have been successfully eliminated.

Another object of the present invention is to provide a temperature-sensitive fuse which can be assembled more easily, with a lesser number of parts in comparison with the conventional temperature-sensitive fuse means.

A temperature-sensitive fuse according to the present invention comprises a cylindrical, tubular, electrically and thermally conductive casing; a first electric conductor which is electrically connected to one end of the casing; a second electric conductor which is connected to the other end of the casing through an electrically insulating material in such a manner so as to be electrically insulated therefrom; a temperature-sensitive, fusible pellet disposed in the end portion of the casing containing the first-conductor, a movable disc member which is disposed in contact with the top portion of the second conductor within the casing and in such a manner that the outer peripheral surface thereof is in slidable contact with the inner wall of the casing; a hold-spring which normally urges the movable disc so as to bring the disc into pressure contact with the top portion of the second conductor; and a pressure-spring for moving the movable disc in the direction away from the top portion of the second conductor when the fusible pellet melts and collapese. The top portion of the second conductor, which is in contact with the central portion of the movable disc, is rounded or formed in the shape of a circular cone. On the other hand, in the central portion of the disc, there is formed a taperad, pierced opening in the axial direction of the tubular casing, into which the top portion of the second conductor can be substantially fitted. In one portion of the disc, there is formed a slit which is open from the tapered opening through an outer peripheral portion of the disc.

These and other objects of the invention will become apparent from the following description of an embodiment thereof when taken together with the drawings:

DETAILED DESCRIPTION OF THE PREFERRED EMBODIMENT

Figure 1:
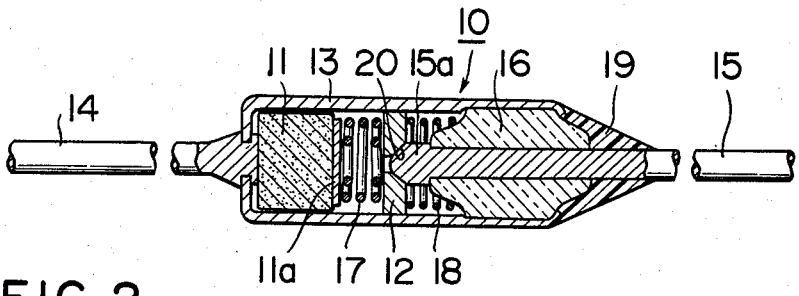
FIG. 1 is a longitudinal cross section of an embodiment of a temperature-sensitive fuse according to the present invention.

Referring to FIG. 1, there is shown an embodiment of a temperature-sensitive fuse, or switch, which is represented by reference numeral 10, according to the present invention. In the figure, the temperature-sensitive fuse 10 comprises a casing 13 which covers a temperature-sensitive fusible pellet 11, a movable disc 12 and other parts which will be described later. The casing 13, made of an electrically and thermally conductive metal, such as copper or a copper alloy, is formed in a cylindrical, tubular shape. To one end of the casing 13, there is electrically connected a first conductor 14 by caulking, and to the other end of the casing 13, there is connected a second conductor 14 in such a manner as to be electrically insulated therefrom through an electrically insulating material 16, for example, ceramics.

Between the first conductor 14 and the second conductor 15 in the casing 13, there are disposed the fusible pellet 11, a disc 11*a*, a comparatively strong hold-spring 17, the movable disc 12, and a comparatively weak pressure-spring 18, in that order.

The fusible pellet 11 is made of an organic compound which melts and collapses at a predetermined temperature. For example, succinic anhydride which melts at 118° C., and tartaric acid which melts at 170° C., are preferred for use in the fusible pellet 11. Other known organic compounds having other melting points can be used, depending upon the desired melting point.

The movable disc 12 is made of a resilient metallic material, such as phosphor bronze. The hold-spring 17 and the pressure-spring 18, which are disposed on the opposite sides of the movable disc 12, respectively urge the movable disc 12 in such a manner as to maintain it at a predetermined position while in contact with the top portion 15*a* of the second conductor 15. In the figure, reference numeral 19 represents an electrically insulating closure made of epoxy resin or the like, which covers the end portion of the electrically insulating material 16.

The top portion 15*a* of the second conductor 15 is rounded or in the shape of a circular cone, and in a central portion of the movable disc 12 there is formed a tapered opening 20 with a curved surface or conical surface, into which the top portion 15*a* of the second conductor 15 can be substantially fitted.

The movable disc 12 is designed so as to expand in the radial direction thereof when the top portion 15*a* of the second conductor 15 is forced into the tapered opening 20, so that the outer peripheral surface of the movable disc 12 is brought into pressure contact with the inner wall of the casing 13.

Figure 2:
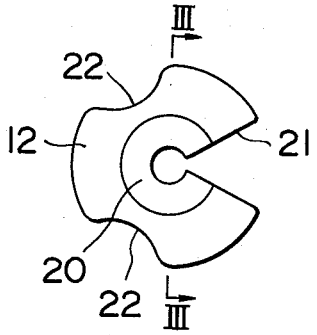
FIG. 2 is a plan view of a movable disc employed in the temperature-sensitive fuse in FIG. 1.
Figure 3:
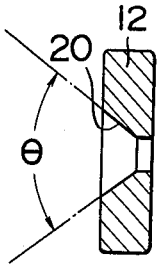
FIG. 3 is a cross section taken on line III—III in FIG. 2.

In order to faciliate the expansion of the movable member 12 in the radial direction thereof, the movable member 12 is designed as shown in FIG. 2 and FIG. 3. Specifically, the tapered opening 20 is formed in the movable disc 12 in such a manner as to pierce the movable disc 12 in the axial direction of the casing 12, and in one portion of the movable disc 12, around the tapered opening 20, there is formed a slit 21 which is open from the tapered opening to an outer peripheral portion of the disc 12. In the peripheral surface of the movable disc 12, there are formed a plurality of concave portions 22 to allow the molten pellet material to flow past the movable disc 12 and thereby to not hinder the movement of the movable disc 12 away from the second conductor 15.

The opening angle $\theta$ of the tapered opening 22 is in the range of 80° to 90°, most preferably 85°.

Figure 5:
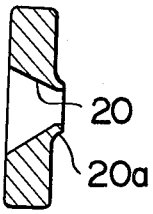
FIG. 5 is a cross section of another movable disc which can be employed in the present invention.

When a projected portion 20*a* is formed around the tapered opening 20 in the movable disc 12 when the opening 20 is formed by press forming as shown in FIG. 5, the face of the disc 12 can be easily recognized when assembling the temperature-sensitive fuse 10, so that it is convenient for assembling the same.

Figure 6:
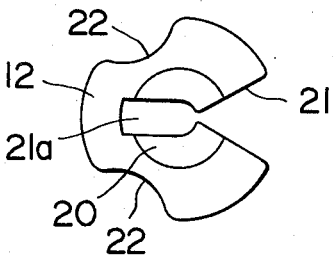
FIG. 6 is a plan view of a further movable disc which can be employed in the present invention.

As shown in FIG. 6, when a notch 21*a* is formed at least in one portion around the tapered opening 20, the expansion of the movable member 12 in the radial direction thereof can be further faciliated.

Normally, in the temperature-sensitive fuse 10, a predetermined space is maintained between the first conductor 14 and the movable disc 12 as shown in FIG. 1 since the fusible pellet 11 is solid and uncollapsed. In this state, since the top portion 15*a* of the second conductor 15 is forced into the tapered opening 20 of the movable disc 12 tending to open the opening 20, the movable disc 12 is urged so as to expand towards the inner wall of the casing 13, maintaining pressure contact with the inner wall of the casing 13, thereby completing the electrical connection between the first conductor 14 and the second conductor 15 via the casing 13 and the movable disc 12.

Figure 4:
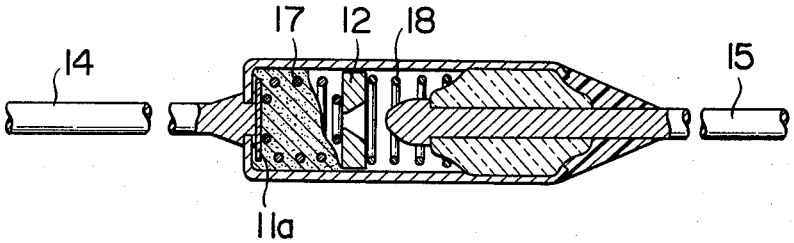
FIG. 4 is a longitudinal cross section of the embodiment in FIG. 1 in operation.

When a predetermined ambient temperature is reached, the fusible pellet 11 melts and collapses, and disc 11*a* is moved to the left by the resilience of the hold-spring 17 in FIG. 1. As a result, the resilience of the pressure-spring 18 exceeds the resilience of the hold-spring 17, so that the movable disc 12 is pushed by the pressure-spring 18, moving away from the second conductor 15 as shown in FIG. 4. Consequently, the movable disc 12 shrinks and is released from the friction with the inner wall of the casing 13, so that the movable disc 12 is moved quickly to the left in FIG. 4, without being joined to the inner wall of the casing 13, thereby breaking the electrical connection between the first conductor 14 and the second conductor 15.

Thus, in the temperature-sensitive fuse according to the present invention, an electric circuit can be interrupted or broken quickly and reliably when the ambient temperature is elevated above a predetermined temperature. Furthermore, the temperature-sensitive fuse can be assembled with a lesser number of parts in comparision with the conventional temperature-sensitive fuse means and therefore, is suitable for mass-production.

Thus, there is provided in accordance with the present invention a temperature-sensitive fuse which has the advantages discussed above. The embodiment described is intended to be merely exemplary and those skilled in the art will be able to make variations and modifications in it without departing from the spirit and scope of the invention. All such modifications and variations are contemplated as falling within the scope of the claims.

What is claimed is:

1. A temperature-sensitive fuse comprising a cylindrical, tubular, electrically and thermally conductive casing; a first electric conductor which is electrically connected to one end of said casing; a second electric conductor which is connected to the other end of said casing through an electrically insulating material in such a manner so as to be electrically insulated therefrom; a temperature-sensitive, fusible pellet disposed in the end portion of said casing containing said first conductor; a movable disc member which is disposed in contact with the top portion of said second conductor within said casing and in such a manner that the outer peripheral surface thereof is in slidable contact with the inner wall of said casing; a hold-spring which normally urges said movable disc so as to bring said movable disc into pressure contact with the top portion of said second conductor; and a pressure-spring for moving said movable disc in the direction away from the top portion of said second conductor when said fusible pellet melts and collapses; the top portion of said second conductor, which is in contact with a central portion of said movable disc, being rounded or formed in the shape of a circular cone, and in the central portion of said disc, a tapered, pierced opening being formed in the axial direction of said tubular casing, into which the top portion of said second conductor can be substantially, fitted, and in one portion of said disc a slit open from said tapered opening to an outer peripheral portion of said disc being formed.

2. A temperature-sensitive fuse as claimed in claim 1, wherein a plurality of concave portions are formed in the outer peripheral surface of said movable disc.

3. A temperature-sensitive fuse as claimed in claim 1, wherein a projected portion is formed around said tapered opening of said movable disc when said tapered opening is formed by press forming.

4. A temperature-sensitive fuse as claimed in claim 1, wherein at least one notch portion is formed around said tapered opening of said movable disc.

* * * * *